United States Patent [19]

Wickham

[11] 4,046,488

[45] Sept. 6, 1977

[54] RADIATOR COOLING FAN

[76] Inventor: Robert G. Wickham, 3643 Jefferson, Clarklake, Mich. 49234

[21] Appl. No.: 629,719

[22] Filed: Nov. 7, 1975

[51] Int. Cl.[2] ..... F04D 29/34

[52] U.S. Cl. ..... 416/210 R; 416/132 A; 416/236 R; 416/DIG. 3

[58] Field of Search ..... 416/210, 132 A, DIG. 3, 416/236, 236 A, DIG. 1, 211, 239

[56] References Cited

U.S. PATENT DOCUMENTS

| | | | |
|---|---|---|---|
| 1,043,830 | 11/1912 | Heath | 416/DIG. 3 |
| 1,121,335 | 12/1914 | Dilg | 416/240 X |
| 1,241,166 | 9/1917 | Swenson | 416/132 |
| 1,479,895 | 1/1924 | Colby | 416/DIG. 3 |
| 1,634,554 | 7/1927 | Pajalic | 416/DIG. 3 |
| 1,868,528 | 7/1932 | Gardner | 416/DIG. 3 |
| 2,559,831 | 7/1951 | Roffy | 416/DIG. 3 |
| 2,579,119 | 12/1951 | McDerment | 416/212 |
| 2,581,873 | 1/1952 | Morrison | 416/DIG. 3 |
| 2,681,708 | 6/1954 | Mix | 416/210 |
| 2,794,509 | 6/1957 | Mix | 416/214 |
| 3,406,760 | 10/1968 | Weir | 416/240 |
| 3,799,699 | 3/1974 | Master et al. | 416/206 |
| 3,963,373 | 6/1976 | Macauley | 416/DIG. 3 |

FOREIGN PATENT DOCUMENTS

| | | | |
|---|---|---|---|
| 606,617 | 10/1960 | Canada | 416/236 A |
| 411,904 | 6/1910 | France | 416/210 |
| 565,262 | 11/1944 | United Kingdom | 416/DIG. 3 |
| 1,321,261 | 6/1973 | United Kingdom | 416/DIG. 3 |

*Primary Examiner*—Everette A. Powell, Jr.
*Attorney, Agent, or Firm*—John L. Cline

[57] ABSTRACT

An improved radiator cooling fan has a substantially planar mounting hub and individually twisted blades extending radially therefrom. Each blade includes reinforcing edges along a portion thereof to enhance durability and lengthen useful service life.

1 Claim, 6 Drawing Figures

RADIATOR COOLING FAN

BACKGROUND OF THE INVENTION

The present invention relates to an improved radiator cooling fan having a planar mounting hub and blades extending radially therefrom.

A variety of fan structures have been developed for use in automotive cooling systems. These fan structures must be capable of withstanding extreme environmental conditions and minimizing operational noise levels while still providing suitable airflow over the radiator and vehicle engine. Therefor, it is important that radiator cooling fans be ruggedly constructed so as to provide long service life substantially free from maintenance.

In addition, it is important that radiator cooling fans weigh as little as possible, since increased weight may adversely affect the operational life of other associated engine components, such as the water pump. Accordingly, the construction of prior art cooling fans has required a compromise between durability and the overall weight of the fans.

Finally, due to the highly competitive nature of this industry and the large volume of radiator fan structures sold annually, small savings in the cost of manufacture can be of significant importance.

Typical prior art fan structures include a central, spider-like member having a single blade attached to each of the radiating arms thereof. The arms of the spider are twisted to provide an appropriate angular displacement for the blades. Significantly, the spider members of such prior art radiator cooling fans usually require a stress relieving process to assure that the spider arm twist operation does not introduce small cracks which would impair the structural integrity of the fan for the normal operating life of the vehicles in which they are used. In addition, due to the extreme and prolonged forces to which these fans are exposed, the spider members of prior art fans are typically constructed from heavy gauge metals.

SUMMARY OF THE INVENTION

The present invention is directed to a novel design for radiator cooling fans which provides durability, and suitable weight, airflow and noise characteristics, all while minimizing the costs of manufacture.

Generally, the radiator cooling fan of the present invention comprises a substantially planar hub to which the individual blades are attached in circumferentially spaced arrangement. The blades each include a planar inner portion which is adapted to securedly engage the periphery of the hub, a distal portion which is angularly displaced from the plane of the hub and shaped to provide suitable airflow, and an intermediate portion which joins these inner and distal portions. The blades are thus individually twisted along their intermediate portion and preferably include reinforcing structure to enhance their structural integrity.

Because of the design of the radiator cooling fan disclosed herein the hub and blades can be fabricated from relatively thin gauge steel without any need for heat treatment. Thus, the costs of materials and manufacture can be significantly reduced.

BRIEF DESCRIPTION OF THE DRAWINGS

The novel features which are believed to be characteristic of the present invention are set forth in the appended claims. The invention itself, however, together with further objects and attendant advantages will be more readily understood by reference to the following description taken in conjunction with the accompanying drawing in which:

DETAILED DESCRIPTION OF THE INVENION

Figure 1:
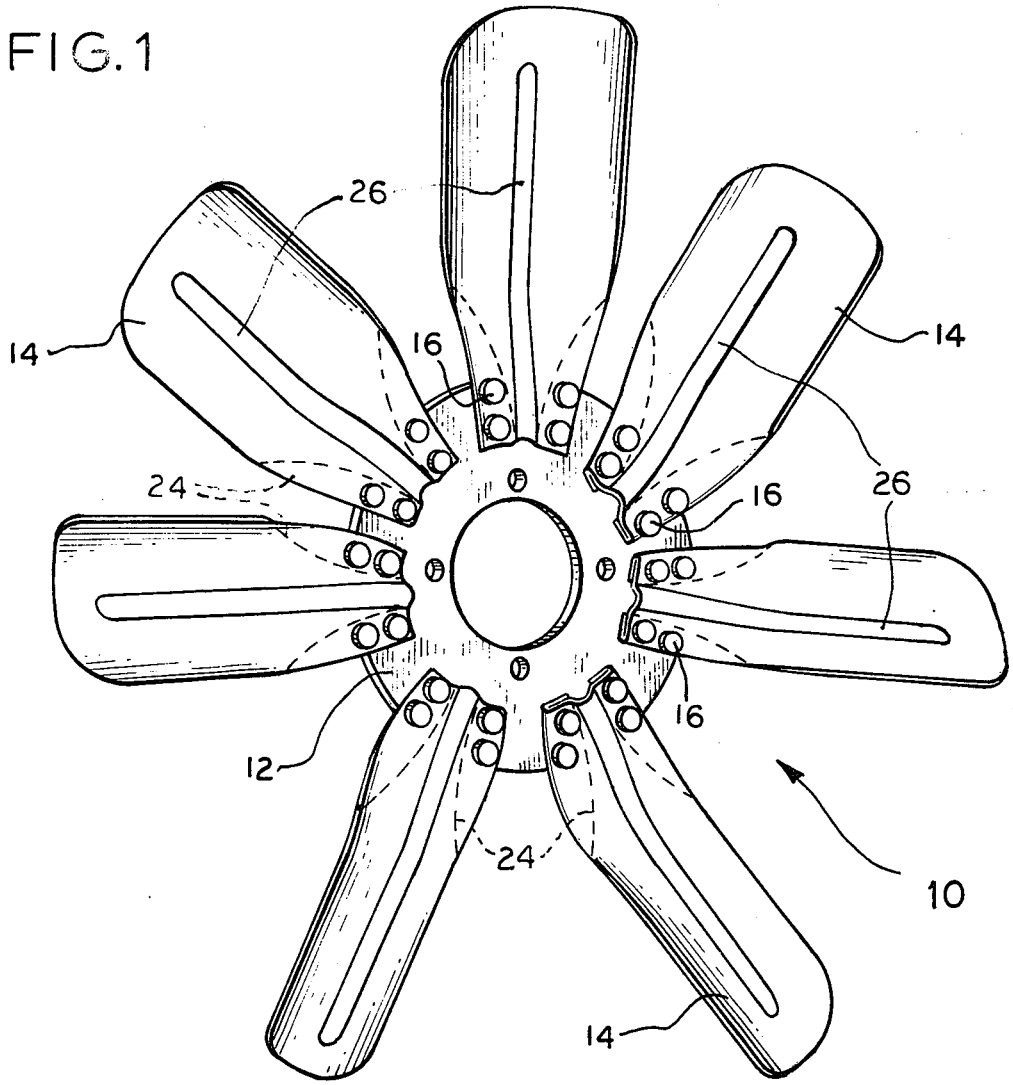
FIG. 1 is a perspective view illustrating a preferred embodiment of the present invention.

Referring to FIG. 1, a radiator cooling fan, designated generally as 10, is shown having a central and substantially planar hub 12 and a plurality of blades 14 extending radially therefrom. The hub 12 and blades 14 can be constructed from any one of a number of suitable materials well known in the art, such as plastic, steel, or aluminum. The blades 14 are each attached to the face of the hub 12 by suitable attachment means, such as rivets 16.

Figure 2:
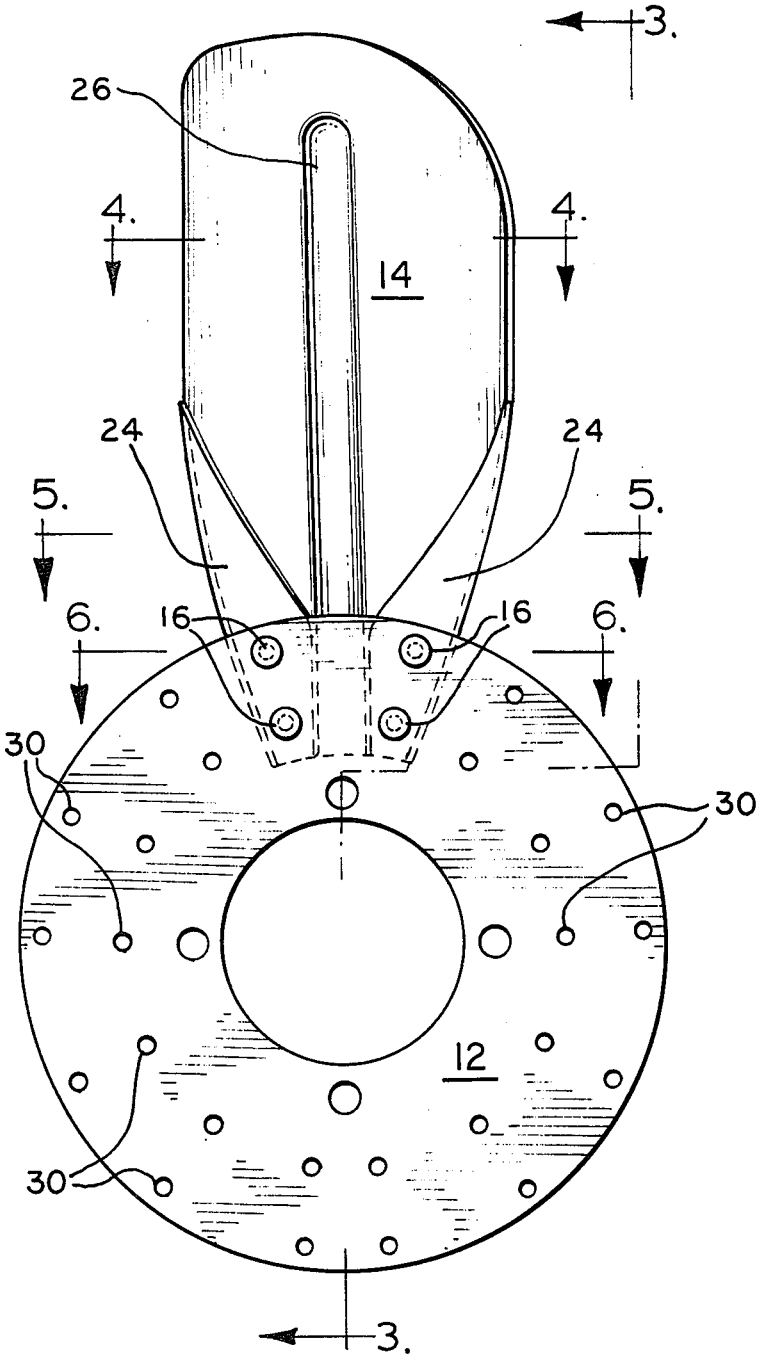
FIG. 2 is a side elevational view taken from the up stream side showing a greater detail the hub and blade used in the fan illustrated in FIG. 1.
Figure 3:
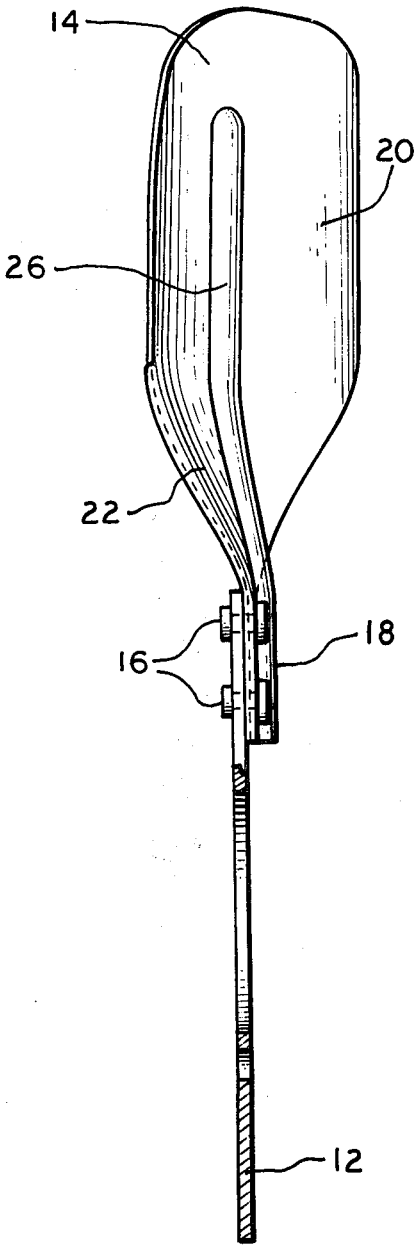

As is more clearly illustrated in FIGS. 2 and 3, each blade 14 has an inner and generally planar portion 18 adapted to securedly engage the hub 12, a distal portion 20 which is angularly displaced from the plane of the hub 12, and an intermediate portion 22 which joins the inner and distal portions.

The use of a substantially planar hub 12 to minimize the forces to which the hub 15 subjected during operation of the fan. Accordingly, thinner materials may be used in its construction thereby saving both costs of manufacture and weight.

Figure 6:
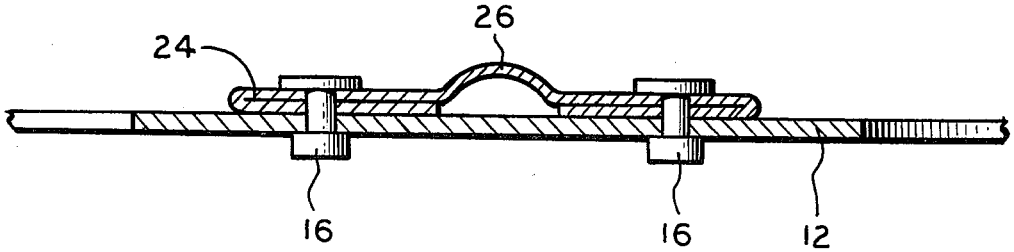
FIGS. 3, 4, 5 and 6 are partial cross-sectional views taken along lines 3—3, 4—4, 5—5 and 6—6, respectively, of FIG. 2.
Figure 4:
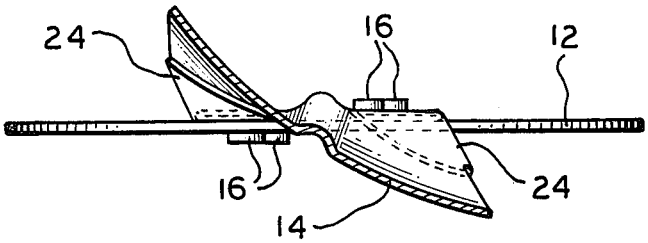
Figure 5:
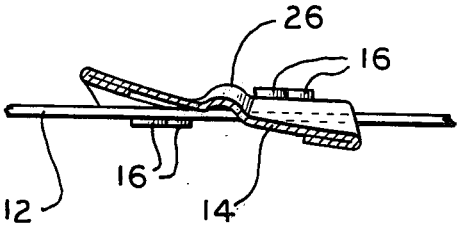

In accordance with another feature of the invention, the blades 14 are each provided with reinforcing means along the inner and intermediate portions 18 and 22, respectively, to enhance the structural integrity of the fan. Thus, the blade 14 includes folded edge means 24 coincident with portions 18 and 22. The edge means 24 help to prevent tearing or cracking due to fatigue after prolonged usage and allow the use of material of substantially lesser gauge than would otherwise be feasible. As can best be seen in FIGS. 2 and 6 the edge means 24 is made by folding the body of the blade 14 to form a double-thickness along its edges coincident with the inner and intermediate portion 5.

The blade 14 may also be provided with a longitudinal rib 26 which extends from the base of the inner portion 18, through the intermediate portion 22 and into the distal portion 20 thereof. The rib 26 will also enhance the rigidity and useful life of the fan 10.

It will be appreciated by those skilled in the art that the radiator cooling fan constructed in accordance with the present invention is capable expeditious assembly and require a minimum of low cost materials. In addition, fans having different numbers of blades or blades with different circumferential placement may be manufactured with the same tooling by merely altering the placement of the blade-fastening apertures 30. Thus, significant cost savings are obtained due to the use of a common hub and blade configuration.

Of course, it will be apparent to those skilled in the art that changes and modifications can be made in the preferred embodiments disclosed herein without departing from the spirit of the present inventon nor lessening its attendant advantages. It is intended that all such changes and modifications shall fall within the scope of the appended claims.

I claim:

1. In a vehicle cooling system, the combination comprising:

a vehicle engine and a radiator system for cooling said engine; and a spiderless fan associated with said radiator including a substantially planar, annular mounting hub;

a plurality of elongated fan blades, each of said fan blades being twisted, having a radially extending reinforcing rib formed (therein) therein and being folded upon themselves along a portion less than the entire length of both the leading and trailing edges and being riveted to said hub through both of said folded edges, said folded edges extending radially beyond said hub and radially within said hub.

* * * * *

UNITED STATES PATENT AND TRADEMARK OFFICE

CERTIFICATE OF CORRECTION

PATENT NO. : 4,046,488

DATED : September 6, 1977

INVENTOR(S) : Robert G. Wickham

It is certified that error appears in the above-identified patent and that said Letters Patent are hereby corrected as shown below:

| | |
|---|---|
| Column 1, Line 13 | Change "Therefor" to -- Therefore -- |
| Column 1, Line 36 | Change "fan" to -- fans -- |
| Column 2, Line 9 | Change "a" to -- in -- |
| Column 2, Line 32 | Insert "is" after "15" |
| Column 2, Line 56 | Insert "of" after "capable" |
| Column 2, Line 57 | Change "require" to -- requires -- |
| Column 4, Line 3 | Delete "(therein)" |

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*